US008821313B1

(12) United States Patent
Dawson et al.

(10) Patent No.: US 8,821,313 B1
(45) Date of Patent: Sep. 2, 2014

(54) IRON-TYPE GOLF CLUB HEAD

(71) Applicant: Callaway Golf Company, Carlsbad, CA (US)

(72) Inventors: Patrick Dawson, San Diego, CA (US); Sean Griffin, Carlsbad, CA (US); Brett Carter, Carlsbad, CA (US); Irina Ivanova, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 94 days.

(21) Appl. No.: 13/761,863

(22) Filed: Feb. 7, 2013

Related U.S. Application Data

(60) Provisional application No. 61/701,533, filed on Sep. 14, 2012.

(51) Int. Cl.
*A63B 53/04* (2006.01)
*A63B 53/06* (2006.01)
*A63B 59/00* (2006.01)

(52) U.S. Cl.
CPC ..... *A63B 53/0475* (2013.01); *A63B 59/0092* (2013.01)
USPC ..... 473/329; 473/332; 473/335; 473/338; 473/342; 473/349; 473/350

(58) Field of Classification Search
USPC ..... 473/324–350, 287–292
See application file for complete search history.

(56) References Cited

U.S. PATENT DOCUMENTS

| | | | | | |
|---|---|---|---|---|---|
| 3,970,236 | A * | 7/1976 | Rogers | 228/196 |
| 4,398,965 | A * | 8/1983 | Campau | 148/522 |
| 4,645,207 | A * | 2/1987 | Teramoto et al. | 473/290 |
| 5,078,397 | A | 1/1992 | Aizawa | |
| 5,184,823 | A * | 2/1993 | Desboilles et al. | 473/345 |
| 5,522,593 | A * | 6/1996 | Kobayashi et al. | 473/349 |
| 5,669,826 | A * | 9/1997 | Chang et al. | 473/332 |
| 5,816,936 | A | 10/1998 | Aizawa et al. | |
| 5,833,551 | A * | 11/1998 | Vincent et al. | 473/350 |
| 5,842,934 | A | 12/1998 | Ezaki et al. | |
| 6,045,456 | A | 4/2000 | Best et al. | |
| 6,220,971 | B1 | 4/2001 | Takeda | |
| 6,981,924 | B2 * | 1/2006 | Deshmukh | 473/342 |
| 7,018,305 | B2 | 3/2006 | Sugimoto | |
| 7,207,899 | B2 | 4/2007 | Imamoto | |
| 7,232,380 | B2 | 6/2007 | Nakahara | |
| 7,303,486 | B2 | 12/2007 | Imamoto | |
| 8,152,651 | B2 | 4/2012 | Roach | |
| 8,206,237 | B2 * | 6/2012 | Gilbert et al. | 473/309 |
| 8,210,965 | B2 | 7/2012 | Roach et al. | |
| 8,216,088 | B2 * | 7/2012 | Hatton et al. | 473/335 |
| 2002/0082119 | A1 * | 6/2002 | Hamada et al. | 473/350 |
| 2005/0143190 | A1 * | 6/2005 | Takeda | 473/342 |
| 2005/0197208 | A1 * | 9/2005 | Imamoto | 473/349 |
| 2007/0026965 | A1 * | 2/2007 | Huang | 473/342 |
| 2007/0281796 | A1 * | 12/2007 | Gilbert et al. | 473/332 |

(Continued)

*Primary Examiner* — Sebastiano Passaniti
(74) *Attorney, Agent, or Firm* — Rebecca Hanovice; Michael A. Catania; Sonia Lari

(57) ABSTRACT

An iron-type golf club head comprising a high strength face plate with a face support is disclosed herein. In particular, the face plate is affixed to a perimeter region and to a face support that extends upwards from the sole proximate a front opening. The face plate preferably is welded to the perimeter region and brazed to the face support to optimize the sound and feel of the golf club head while preserving the strength of the face.

2 Claims, 5 Drawing Sheets

(56) References Cited

U.S. PATENT DOCUMENTS

| | | | | |
|---|---|---|---|---|
| 2008/0020860 | A1* | 1/2008 | Imamoto | 473/332 |
| 2008/0085782 | A1* | 4/2008 | Kubota | 473/350 |
| 2009/0111607 | A1 | 4/2009 | Taylor et al. | |
| 2009/0137339 | A1* | 5/2009 | Nakano | 473/350 |
| 2010/0190568 | A1* | 7/2010 | Gilbert et al. | 473/290 |
| 2010/0261540 | A1 | 10/2010 | Roach | |
| 2011/0028240 | A1* | 2/2011 | Wahl et al. | 473/346 |
| 2011/0143857 | A1 | 6/2011 | Roach et al. | |
| 2011/0159984 | A1* | 6/2011 | Shimazaki | 473/331 |
| 2011/0230279 | A1 | 9/2011 | Oldknow et al. | |
| 2012/0122606 | A1 | 5/2012 | Yamamoto | |

* cited by examiner

IRON-TYPE GOLF CLUB HEAD

CROSS REFERENCES TO RELATED APPLICATIONS

The present application claims priority to U.S. Provisional Patent Application No. 61/701,533, filed on Sep. 14, 2012, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with improved sound and forgiveness. More specifically, the present invention relates to an iron-type golf club head having a unique body construction designed to provide greater support to the face plate across its center.

2. Description of the Related Art

The prior art discloses various types of high strength faces for use with golf club heads, and particularly iron-type golf club heads. Using a high strength face allows for a decrease in face thickness without negatively affecting durability, and is traditionally used in clubs designed for players who need greater forgiveness. Traditionally, these types of golf club faces are welded to the rest of the golf club body only at a perimeter region of the body, which typically has an opening sized to receive the face and allow it to flex inwardly. One drawback of this configuration, however, is that, while the face flexes inside the perimeter weld, it can come into contact with thicker sections or other metal parts of the head. If this happens, the golf club head can resonate during impact and create a displeasing sound.

This problem limits the quantity of thick sections of the club head that are permitted to touch the face, and thus impacts the overall design of the golf club head. It also leads manufacturers to include undercut features with clubs having face inserts so that material is moved far away from the face. Though many players use undercut features, more advanced golfers tend to not like undercuts because of the association between undercuts and less skilled golfers, and thus prefer to use clubs without them. As such, there is a need for a golf club head having a face insert that has a design that is both appealing to more skilled users and causes a pleasing sound upon impact with a golf ball.

BRIEF SUMMARY OF THE INVENTION

The present invention provides a golf club having improved sound comprising a high strength face, which is constrained across its center with an additional weld or braze. The inclusion of thick portions against the face leads to a golf club head that includes a face insert while at the same time appealing to more highly skilled golfers.

One aspect of the present invention is an iron-type golf club head comprising a body having a perimeter region and a cavity and face plate that is welded to the perimeter region. The body preferably includes a front raised portion that rests against the back of the face plate, and the face plate is also welded to this front raised portion. In alternative embodiments, the face plate may be brazed, soldered, and/or welded to these portions of the body. The front raised portion may also include a cavity to remove weight from the golf club head. The front raised portion acts as a support for the face plate and helps reduce unpleasant sound during play.

Another aspect of the present invention is an iron-type golf club head comprising a body comprising a top portion, a sole portion, a heel portion, a toe portion, a front opening, and a rear cavity, and a face plate, wherein the sole portion comprises a raised portion comprising a front surface and an upper surface, wherein the raised portion extends upwards from the sole proximate the front opening, wherein the face plate is affixed to the top portion, sole portion, heel portion, and toe portion and closes the front opening, and wherein the face plate is brazed to at least a portion of the front surface of the raised portion. In some embodiments, the raised portion may comprise a recess disposed in the front surface of the raised portion, which may be filled with a polymeric material such as rubber or foam. In some embodiments, the iron-type golf club head may have a major excited mode of interest of 5000-5600 Hz and 75-85 dB.

In other embodiments, the face plate may be welded to at least one of the top portion, sole portion, heel portion, and toe portion. The iron-type golf club head may further comprise a tungsten weight, which may be disposed within a cavity in the sole comprises a cavity, either removably or permanently via welding. In some embodiments, the body may be composed of a first metal alloy such as 1020 carbon steel, the face plate may be composed of a second metal alloy such as a high strength steel, and the first metal alloy may be different from the second metal alloy. In some embodiments, the sole portion may comprise a rear surface and a bottom surface, and at least one of the rear surface and the bottom surface may comprise a cavity.

Yet another aspect of the present invention is an iron-type golf club head comprising a 1020 carbon steel body comprising a top portion, a sole portion, a heel portion, a toe portion, a front opening, and a rear cavity, and a steel face plate, wherein the sole portion comprises a first cavity and a raised portion comprising a flat front surface, wherein the raised portion extends upwards from the sole proximate the front opening, wherein the face plate is welded to the top portion, sole portion, heel portion, and toe portion and closes the front opening, wherein the face plate is brazed to the entire front surface of the raised portion, wherein the iron-type golf club head has a major excited mode of interest of 5000-5600 Hz and 75-85 dB, and wherein the first cavity is disposed in a bottom most surface of the sole portion. In some embodiments, the iron-type golf club head may further comprise a second cavity disposed in a rear-most surface of the sole portion, which may include a weight made of a high density material such as a tungsten alloy.

In some embodiments, the raised portion may comprise a recess, which may be disposed in the front surface of the raised portion, and which may be filled with a resilient polymeric material. In other embodiments, the golf club head may have an Izz of 2000-2500 g-cm$^2$ and an Iyy of 500-700 g-cm$^2$. In still other embodiments, the golf club head may comprise a center of gravity with a depth of 0.140-0.180 inch and a height of 0.070-0.140 inch.

Another aspect of the present invention is an iron-type golf club head comprising a 1020 carbon steel body comprising a top portion, a sole portion, a heel portion, a toe portion, a front opening, and a rear cavity, and a steel face plate, wherein the sole portion comprises a raised portion comprising a flat front surface, a concave upper surface, and a recess disposed in the front surface, wherein the raised portion extends upwards from the sole proximate the front opening, wherein the face plate is welded to at least one of the top portion, sole portion, heel portion, and toe portion and closes the front opening, wherein the face plate is brazed to the front surface of the raised portion, wherein the iron-type golf club head has a major excited mode of interest of 5000-5600 Hz and 75-85 dB, wherein the iron-type golf club head has an Izz of 2000-2500 g-cm$^2$ and an Iyy of 500-700 g-cm$^2$, and wherein the iron-type golf club head has a center of gravity with a depth of 0.140-0.180 inch and a height of 0.070-0.140 inch. Some embodiments may further comprise at least one tungsten weight insert disposed in one or more cavities of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
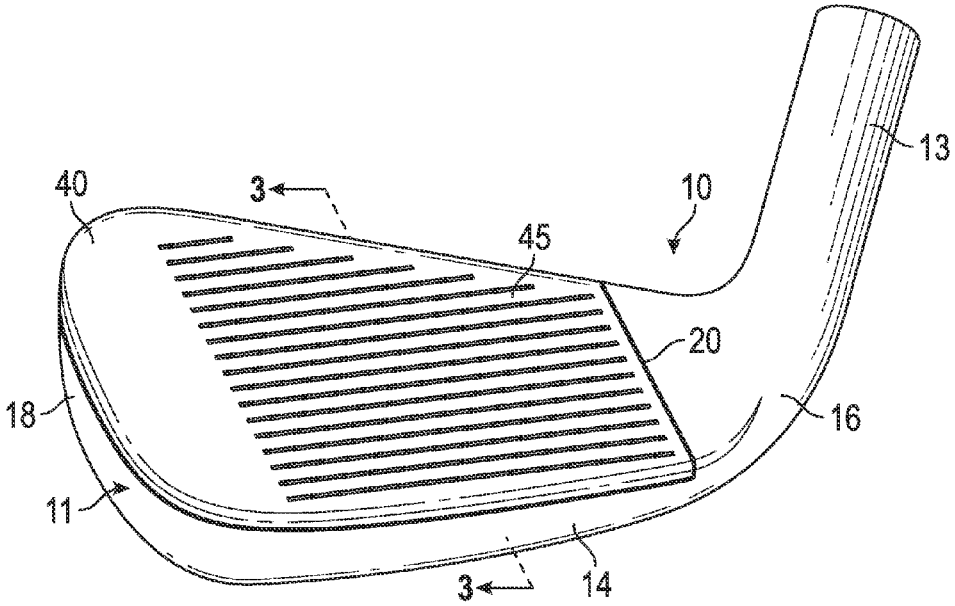
FIG. 1 is a front view of a first embodiment of the present invention.
Figure 2:
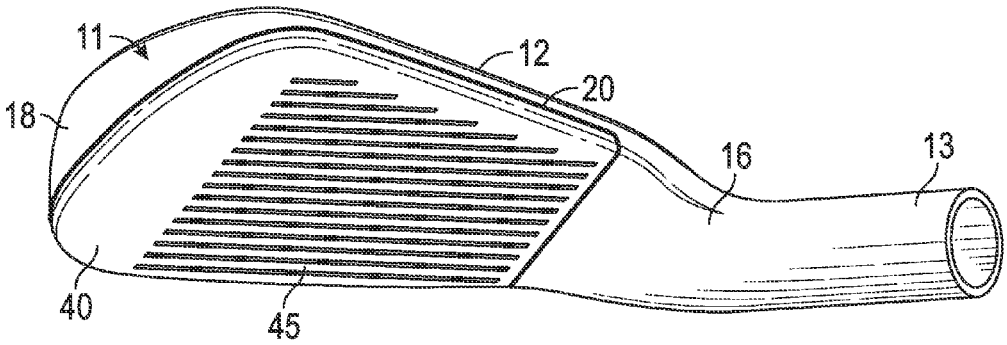
FIG. 2 is a top view of the embodiment shown in FIG. 1.
Figure 3:
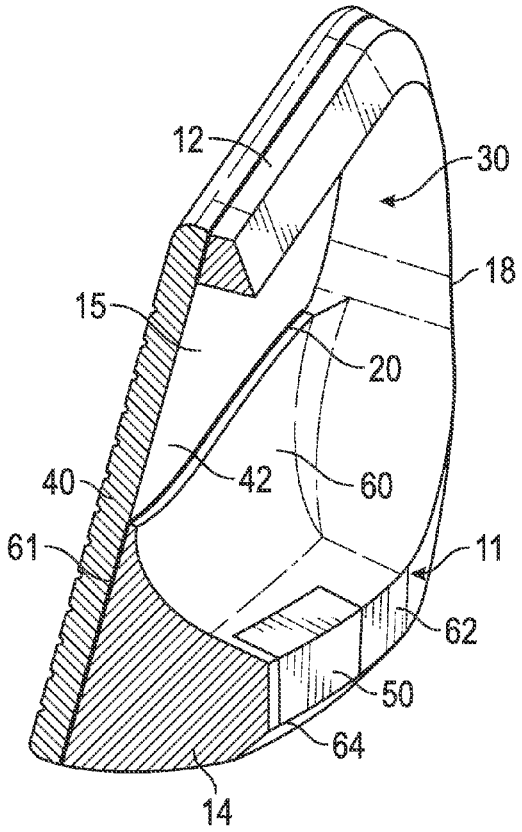
FIG. 3 is a cross-sectional view of the embodiment shown in FIG. 1 along lines 3-3.

A first embodiment of the iron-type golf club head 10 of the present invention is shown in FIGS. 1-3. The golf club head 10 has a body 11 with a front opening 15, a top portion 12 (also called a top rail), a sole portion 14, a heel portion 16, a toe portion 18, which collectively are also known as a perimeter region, a hosel 13, and a rear cavity 30 encircled by the top portion 12, sole portion 14, and heel and toe portions 16, 18. The body 11 also includes a front raised portion 60 that extends upwards from the sole portion 14 proximate the front opening 15 and makes contact with the heel and toe portions 16, 18. As shown in FIG. 3, the front raised portion 60 preferably slopes concavely upwards from a rear surface 62 of the sole portion 14, and has a greatest height proximate the heel and toe portions 16, 18 and a smallest height midway between the heel and toe portions 16, 18.

A face plate 40 with a plurality of grooves 45 is welded to a front surface of the perimeter region of the body 11 and also to a front surface 61 of the front raised portion 60, closing off the front opening 15. As shown in FIGS. 1-3, the face plate 40 preferably has the same height and width as the body 11 so that its upper surface is flush with the top portion 12, its lower surface is flush with the sole portion 14, its heel side is flush with the heel portion 16, and its toe side is flush with the toe portion 18. A weld bead 20 supports the face along the perimeter region and also along the front raised portion 60, which improves the sound of the golf club head. A weight 50 is also inserted into a cavity 64 within the sole portion 14 to adjust golf club head moment of inertia, weight, and center of gravity location. The weight 50 may be made of any material, but preferably is composed of a high density material such as tungsten.

Figure 4:
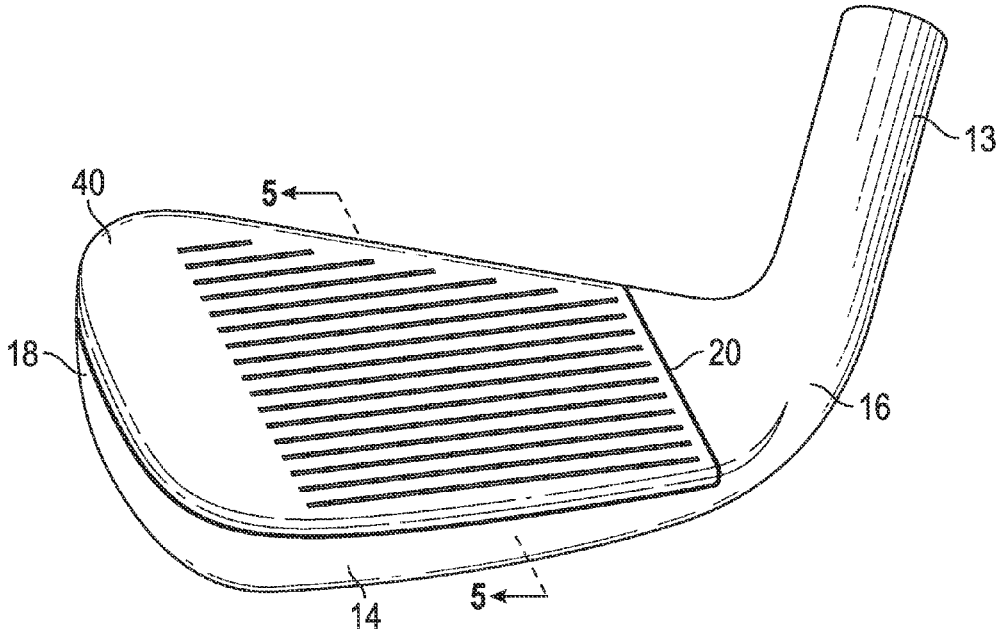
FIG. 4 is a front view of a second embodiment of the present invention.
Figure 5:
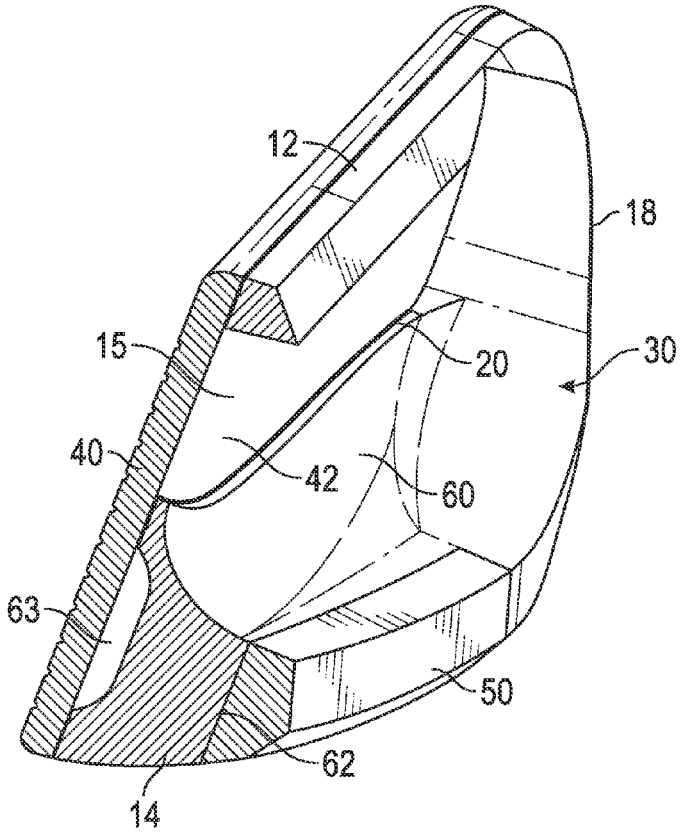
FIG. 5 is a cross-sectional view of the embodiment shown in FIG. 4 along lines 5-5.

A second embodiment of the iron-type golf club head of the present invention is shown in FIGS. 4-5. This embodiment is similar to the first embodiment, but it further includes a cavity 63 in a front surface 61 of the front raised portion 60 to reduce the overall weight of the body 11. The weight 50 included in this embodiment is larger, and is affixed to and extends across the rear surface 62 of the sole portion 14. The cavity 63 may be left empty, or it may be filled with a lightweight, low density material such as rubber or another polymer.

Figure 6:
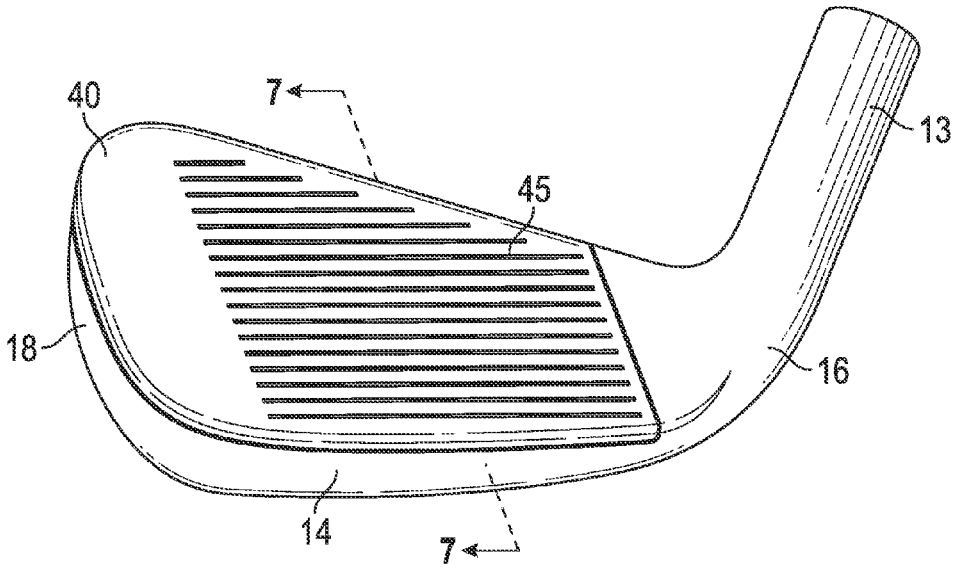
FIG. 6 is a front view of a third embodiment of the present invention.
Figure 7:
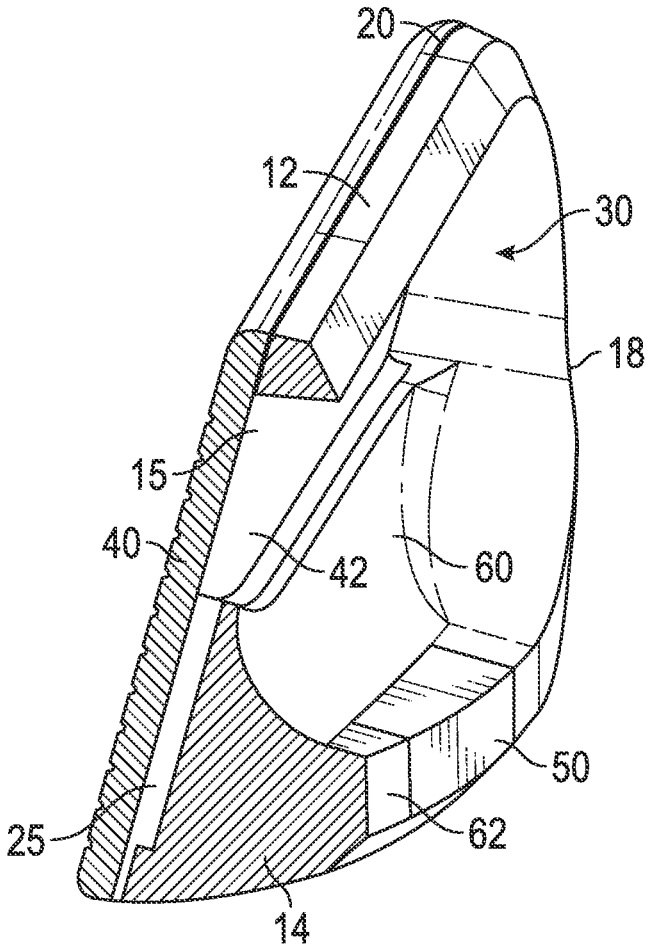
FIG. 7 is a cross-sectional view of the embodiment shown in FIG. 6 along lines 7-7.

A third embodiment of the present invention is shown in FIGS. 6-7. This embodiment is also similar to the first embodiment, but instead of welding the face plate 40 to the front raised portion 60, the face is brazed to the front surface 61 of the front raised portion 60 and welded to the perimeter region. The brazing material 25 contacts a middle portion of a rear surface 42 of the face plate 40, while the weld bead 20 is disposed between the face plate 40 and the perimeter region.

Figure 8:
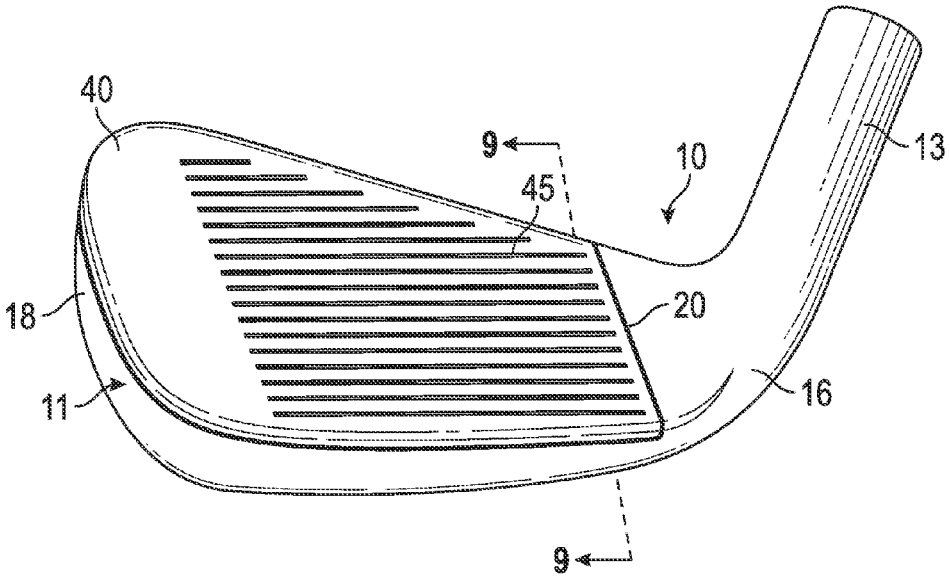
FIG. 8 is a fourth embodiment of the present invention.
Figure 9:
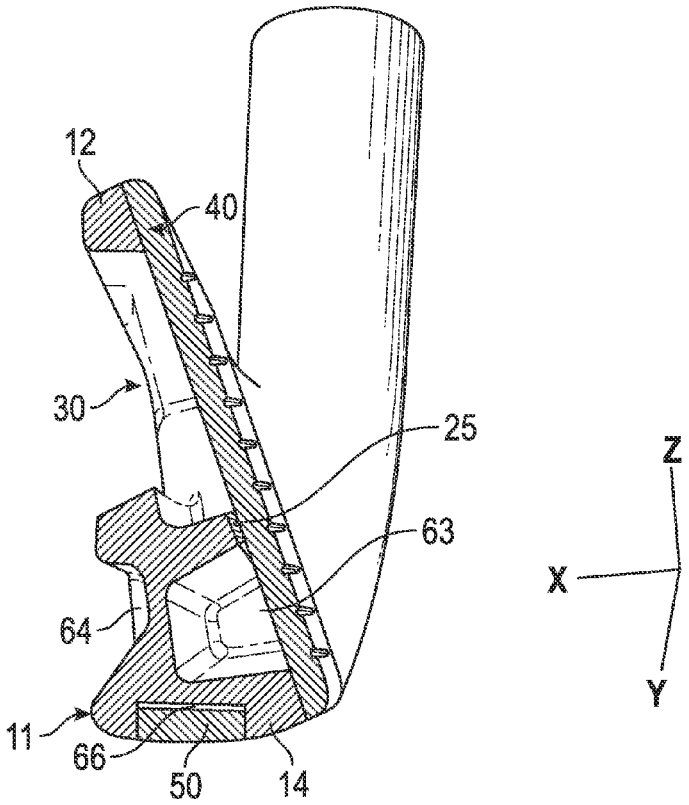
FIG. 9 is a cross-sectional view of the embodiment shown in FIG. 8 along lines 9-9.

A preferred embodiment of the present invention is shown in FIGS. 8-9. This embodiment is similar to the first embodiment, with a body 11 having a perimeter portion composed of a top portion 12, sole portion 14, heel portion 16, toe portion 18, front opening 15, a rear cavity 30, and a front raised portion 60, and a face plate 40 covering all front surfaces of the body 11 and closing the front opening 15. The preferred embodiment also combines features of the second and third embodiments, as it includes a large cavity 63 extending into the front surface 61 of the front raised portion 60, a cavity 64 extending into a rear surface 62 of the sole portion 14, and brazing material 25 affixing the face plate 40 to the front surface 61 of the front raised portion 60. The preferred embodiment also includes a shallow cavity 66 extending into the bottom surface 65 of the sole portion 14, and a tungsten-alloy weight 50 welded within the shallow cavity 66.

The body 11 of the preferred embodiment is composed of 1020 carbon steel, while the face plate 40 is composed of high strength steel. The large cavity 63 is left empty to help move the center of gravity downward and away from the face plate 40, such that the center of gravity depth (along an x axis, which is perpendicular to the club face) from the face is 0.14-0.18 inches and the center of gravity height (along a z axis, which is perpendicular to a ground plane) from the ground plane is 0.070-0.140 inches. The preferred embodiment of the present invention preferably has a vertical moment of inertia (MOI) (Izz) of 2000-2500 g-cm$^2$, and a horizontal MOI (Iyy) of 500-700 g-cm$^2$. The preferred embodiment also preferably has an overall head weight of 230-300 grams.

This construction, and particularly the brazing between the face plate 40 and the front surface 61 of the front raised portion 60, leads to excellent sound when the golf club head 10 makes contact with a golf ball, as it creates high frequency and low amplitude. For example, when a golf club head 10 having all of the features of the preferred embodiment but not the brazing material 25 was tested, it led to a major excited mode of interest of 4750 Hz and 90 dB. When brazing material 25 was included, the golf club head 10 had a more desirable major excited mode of interest of 5400 Hz and 82 dB.

In each of the embodiments disclosed herein, the face plate 40 may be attached to the body via welding, brazing, soldering, or a combination of these methods. The golf club head 10 may be composed of 1020 carbon steel, titanium alloy, stainless steel, carpenter steel, or amorphous metals and the like, and may be manufactured via any method known to a person of ordinary skill in the art, including forging, casting, forming, machining, powdered metal forming, metal-injection-molding, and electro-chemical milling. The invention disclosed herein may, in alternative embodiments, be used in connection with other types of golf club heads, including woods, putters, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing.

We claim:

1. An iron-type golf club head comprising:

a 1020 carbon steel body comprising a top portion, a sole portion, a heel portion, a toe portion, a front opening, and a rear cavity; and a steel face plate, wherein the sole portion comprises a raised portion comprising a flat front surface, a concave upper surface, and a recess disposed in the front surface, wherein the raised portion extends upwards from the sole proximate the front opening, wherein the face plate is welded to at least one of the top portion, sole portion, heel portion, and toe portion and closes the front opening, wherein the face plate is brazed to the front surface of the raised portion, wherein the iron-type golf club head has a major excited mode of interest of 5000-5600 Hz and 75-85 dB, wherein the iron-type golf club head has an Izz of 2000-2500 g-cm$^2$ and an Iyy of 500-700 g-cm$^2$, and wherein the iron-type golf club head has a center of gravity with a depth of 0.140-0.180 inch and a height of 0.070-0.140 inch.

2. The iron-type golf club head of claim 1, further comprising at least one tungsten weight insert.

* * * * *